US007841454B2

(12) United States Patent
Burton

(10) Patent No.: US 7,841,454 B2
(45) Date of Patent: Nov. 30, 2010

(54) ADJUSTABLE CARRIER WITH STRAPS

(76) Inventor: Ralph Odell Burton, 4365 Redwing Trail NW., Bremerton, WA (US) 98312

( * ) Notice: Subject to any disclaimer, the term of this patent is extended or adjusted under 35 U.S.C. 154(b) by 146 days.

(21) Appl. No.: 12/031,574

(22) Filed: Feb. 14, 2008

(65) Prior Publication Data

US 2008/0190721 A1 Aug. 14, 2008

Related U.S. Application Data

(60) Provisional application No. 60/889,889, filed on Feb. 14, 2007, provisional application No. 60/945,841, filed on Jun. 22, 2007.

(51) Int. Cl.
*A45C 13/30* (2006.01)

(52) U.S. Cl. ..... 190/108; 190/100; 190/102; 190/110; 190/39

(58) Field of Classification Search ..... 190/108, 190/100, 102, 110, 39
See application file for complete search history.

(56) References Cited

U.S. PATENT DOCUMENTS

| | | | | | |
|---|---|---|---|---|---|
| 227,818 | A * | 5/1880 | Dipadova | 432/153 |
| 2,319,729 | A * | 5/1943 | Ford | 190/102 |
| 2,574,786 | A * | 11/1951 | Hiatt | 383/38 |
| 2,707,035 | A * | 4/1955 | Lashley | 224/616 |
| 2,813,602 | A * | 11/1957 | MacArthur, Jr. | 224/220 |
| 3,729,038 | A * | 4/1973 | Ekeson | 190/110 |
| 3,837,447 | A * | 9/1974 | Honan | 190/110 |
| 4,535,922 | A * | 8/1985 | Yarnold | 224/616 |
| 4,580,667 | A * | 4/1986 | Herwood | 190/110 |
| 4,685,546 | A * | 8/1987 | Sadow | 190/102 |
| 4,759,431 | A | 7/1988 | King et al. | 190/18 |
| 5,520,462 | A * | 5/1996 | Clark | 383/37 |
| 5,947,241 | A * | 9/1999 | Rausch | 190/108 |
| 6,012,557 | A * | 1/2000 | Derelanko | 190/108 |
| 6,283,260 | B1 * | 9/2001 | Yasuda, Sr. | 190/102 |
| 6,347,693 | B1 * | 2/2002 | Chen | 190/102 |
| 6,637,485 | B1 | 10/2003 | Sartena | 150/118 |
| 6,637,563 | B1 * | 10/2003 | Ruckh | 190/108 |
| 7,318,507 | B2 * | 1/2008 | Fenton et al. | 190/39 |
| 2005/0056674 | A1 | 3/2005 | Renn | 224/625 |
| 2005/0232517 | A1 * | 10/2005 | Reid | 383/2 |
| 2006/0088231 | A1 * | 4/2006 | Figlietti | 383/22 |

FOREIGN PATENT DOCUMENTS

| | | |
|---|---|---|
| FR | 2 344 407 | 10/1977 |
| GB | 1 458 044 | 12/1976 |
| WO | WO 01/49145 A1 | 7/2001 |

* cited by examiner

*Primary Examiner*—Anthony Stashick
*Assistant Examiner*—Cynthia F Collado
(74) *Attorney, Agent, or Firm*—David L Garrison

(57) ABSTRACT

Carriers for flat objects such as sheet music are described which supplement the capacity of musical instrument cases having at least one handle. An adjustable hanger strap or straps are provided so that the carrier can be used on cases having different sizes, shapes and thicknesses. The case handle fits through one of a plurality of elongated slots on the hangar strap of the carrier with the carrier positioned against the case. The particular slot used depends on the shape and size of the case. The carrier has one or more compartments for storing articles placed therein, with the carrier draping over one of the sides while being transported about as a single unit by virtue of the case carry handle. Loops engaging the strap are also provided to provide stability.

12 Claims, 4 Drawing Sheets

ADJUSTABLE CARRIER WITH STRAPS

CROSS-REFERENCE TO RELATED APPLICATION

This application claims priority to the disclosure of U.S. Provisional Patent Application No. 60/889,889, entitled "ADJUSTABLE CARRIER," filed Feb. 14, 2007 and U.S. Provisional Patent No. 60/945,841 entitled "ADJUSTABLE CARRIER WITH STRAPS" filed on Jun. 22, 2007.

FIELD OF THE DISCLOSURE

This invention relates to a carrier designed to add additional carrying capacity to an existing carrying case of various sizes and shapes fitted with at least one handle.

BACKGROUND

As is well known and understood, there exists the problem of having to carry, in addition to the standard briefcase, attache case, suitcase, overnight bag or musical instrument case, such items as a personal computer, electronic organizer and cellular phone—as well as binders, books or sheet music. Thus, and as will be appreciated, the current state of affairs typically requires the user to carry several cases each time, for each of these additional items, which makes transport extremely cumbersome and difficult, given the fact that only two hands are available for carrying everything. Oftentimes, as awkward as it may be, a user is forced to carry more than one case in each hand, or beyond even that, carrying some of them over the shoulder or around the neck. Having such a large number of cases, then, makes it difficult to keep track of all of them to prevent forgetting one or more and leaving them behind—or, for security reasons, makes it difficult to keep track of each case in preventing its theft.

One obvious solution is to use a very large carrying case to carry all the items necessary. Whether this case is then carried about by hand, wheeled about, or pulled along on rollers, such a solution is not readily practical as it requires the user to remove the contents of his or her standard briefcase or musical instrument case as used on a daily basis, and place those items in the larger suitcase. This cumbersome large case often does not offer the same protection that a custom fitted laptop or musical instrument case provides. In like vein, the user may only need to supplement the capacity of the case slightly.

The need to compliment the capacity of oddly shaped and sized musical instrument cases is of particular concern. Instrumental directors, parents and students are continually burdened with problems that are related to the transportation, storage and protection of music folders and related items which do not fit within the musical instrument case. Specifically, instrumental directors continually waste time dealing with music folders, sheet music and related items scattered around the rehearsal room floor and instrument storage rooms. Students continually waste time asking others if they have seen their music folder and/or related items and replacing torn or lost music. Students are continually burdened with transporting their music folder and related items to and from school and storing their music folder during transportation. The common solution students have to these problems is to simply cram their materials such as a music folder into their back packs or musical instrument cases. Due to these burdens, the students encounter torn music folders, torn music sheets or even damaged musical instruments. Parents continually waste time dealing with the clutter of music folders and related articles at home. As a result, parents must waste time trying to find their child's music folder and related articles at home and/or at school. Parents frequently encounter the expense of replacing damaged and lost materials.

U.S. Pat. No. 6,012,557, issued to Derelanko, discloses a briefcase companion bag system. However, this invention does not allow the bag to compliment cases of different sizes and shapes.

U.S. Pat. No. 6,637,563 B1, issued to Ruckh discloses a clear plastic case for moving through an airport. However, this invention does not allow the bag to compliment cases of different sizes and shapes. Moreover, the invention attaches to the briefcase's handle, via loops, which impedes easy access to the contents of the briefcase.

U.S. Patent Application 2005/0233517, issued to Reid discloses an airport security pouch. However, this invention if attached to a briefcase handle using straps 24 and 26 would impede the user's use of the briefcase handle.

U.S. Pat. No. 5,947,241, issued to Rausch discloses joinable, soft-side containers. However, this invention does not allow the bag to compliment cases of different sizes and shapes.

U.S. Patent Application 2006/0088231 A1 discloses an enclosed, hangable, folding pouch with a closure. However, the invention is designed to wrap around a carry handle instead of lie over it.

JP 20002259574 discloses a carrying case for mobile tools such as electronic notebooks and portable information terminal units. However, this invention does not seem to attach to a briefcase handle by a strap used to overlie on top of the handle.

It would therefore be beneficial to all users, especially to instrumental directors, students and parents if there was a simple inexpensive solution to the transportation, storage and protection of music folders and related materials. It would also be beneficial if the solution to this problem had the ability to interchangeably accommodate the need of users carrying small cases such as a flute case as well as users carrying large and oddly shaped cases such as a tuba case.

SUMMARY OF THE DISCLOSURE

As will become apparent from the following description, the present invention comprises a carrier which offers a solution to the problems faced by those wishing to supplement the carrying capacity of cases equipped with at least one handle. As will be seen, the carrier is arranged to be placed on cases of varying shapes and sizes equipped with at least one handle, such as a musical instrument case. The configuration of the present invention permits it to engage the handle yet lie in an orientation parallel to and against a major vertical side of the case in an orientation which protects the contents from damage. A translucent outer panel permits viewing of the contents without opening the auxiliary carrying device. Thus, this invention allows many items to be transported along with the musical instrument case, briefcase, attache case, etc. using just one hand while securing and protecting the contents thereof. Such a carrier will be seen to be securable to the briefcase, attache case, small suitcase, overnight bag, etc., to prevent loss of one, or the other, and allows the user to have all the items conveniently secured together, and at the same time deterring theft.

As will become clear from the following description, the carrier can be constructed of a soft material such as a translucent plastic, leather, or nylon, allowing it to be stored inside of a larger case when not in use. The carrier can have a plurality of different compartments to allow a variety of different articles to be carried such as pencils or business cards in addition to documents.

As will be described below, in a preferred embodiment of the present invention a "case" (understood to mean in the following description a standard briefcase, an attache case, a musical instrument case, a small suitcase, an overnight bag, of varying size and shape) of substantial thickness is utilized, having a carry handle and top, bottom, side and end walls. With it, the carrier is employed, also having top, bottom, side and end walls, to provide at least one carrying compartment for additional articles to be placed within. The carrier has attachment means adjustable to fit different thickness and shapes of the case with which it is used and may be moved from one case of one thickness to another case of different thickness.

In one embodiment of the invention, a strap extends from the back of the carrier having a plurality of slots, each wide enough to overlie and accept the carry handle of a case when extended therethrough, while abutting one of the side walls of the carrier against one of the side walls of the case. In this embodiment the user inserts the handle through one of the slots to allow a customizable fit to accommodate cases of varying sizes and shapes. Once the user selects the appropriate slot to accommodate the shape and size of the case, the excess strap material can be trimmed and discarded. In the alternative, the excess may be folded underneath the active portion of the strap, and the end thereof extending back towards the carrier, with the end then secured against the carrier. In this embodiment, the carrier may be universally used with various cases of varying thicknesses.

In another embodiment, a pair of straps extend from the back of the folder. Each strap is attached at or near the lower end of the back panel of the folder. The straps are constructed with a surface having a hook and loop material or other similar fastening material. At or near the top end of the back panel of the folder are loops intended to receive the straps. This embodiment allows the user to insert the straps through the loops before attaching the straps to the handle. This enables the back side of the folder to abut the side of a case of various sizes and shapes. The loops securely attach the carrier to the case and aide in positioning the backside of the carrier against one of the side walls of the case. Once the user attaches the hook and loop straps to the handle to accommodate the shape and size of the case, the excess strap material can be trimmed and discarded.

The part of the carrier that will contain the articles can be configured for objects of various shapes or as a folder for flat objects such as papers or manuscripts. The carrier can be constructed with different designs selected for the bag and folder constructions which allows for a versatile customizable system, permitting a user to select between different types of available carrier dimensions that might meet various requirements.

In one embodiment of the invention, the part of the carrier used to contain articles is a bag. The bag has at least one openable wall. A fastener on the openable wall secures the contents inside of the bag by hook and loop fastener, snap fastener, button, clasp or any other suitable fastener known to those skilled in the art.

It is a major object of the carrier to transport and protect paper music sheets and related items in a folder that attaches to a musical instrument case of various shape and size. This is accomplished by use of a wide fastener strap having a plurality of slots extending transversely along the length of the strap. The plurality of slots allows the user to adjust the location of the carrier to a secure location against on side of the musical instrument cases of varying shapes and thicknesses. For larger instrument cases, the carrier strap is inserted through a loop that is located on the back of the carrier, which keeps the carrier adjacent to the side of the case thereby providing enhanced stability.

In the above one embodiment of the invention, the folder is opened by a flap. The flap can be secured by a hook and loop fastener, zipper, snap, or any suitable method know to those skilled in the art. In another embodiment of the invention, the folder has expandable sides in the form of bellows or equivalents to accommodate articles of varying thickness.

BRIEF DESCRIPTION OF THE DRAWINGS

The objects and features of the present invention, which are believed to be novel, are set forth in the appended claims. The present invention, both as to its organization and manner of operation, together with further objects and advantages, may best be understood by reference to the following descriptions, taken in conjunction with the accompanying drawings, wherein:

Referring to the drawings, where like numerals indicate like parts, there is seen in FIGS. 1-5, a first embodiment of this invention. FIG. 1 shows a perspective view of this embodiment installed on a case 30.

DETAILED DESCRIPTION

Figure 2:
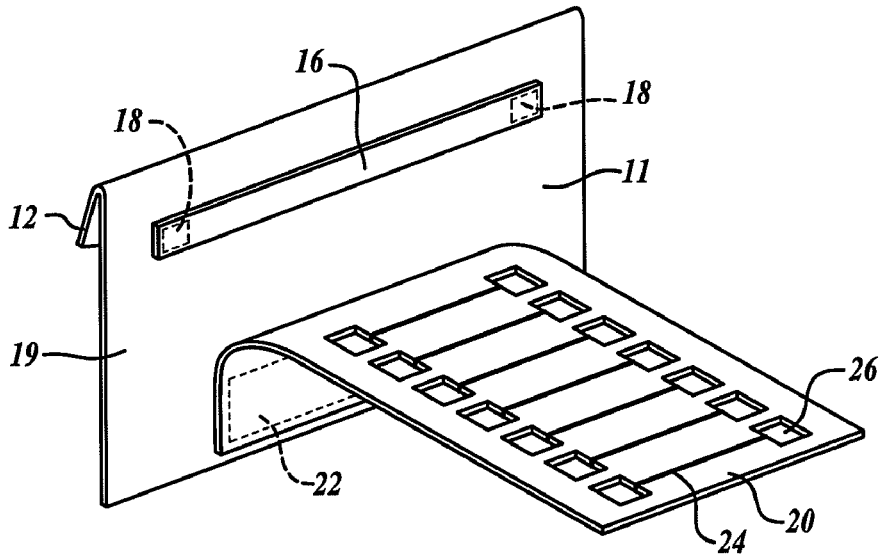
FIG. 2 is a perspective view of the back of the invention shown in FIG. 1.

FIG. 2 shows carrier 11, loop 16, loop attachment 18, flap 12, the back side of the carrier 19, strap 20, strap attachment 22, slits 24, and handle cut outs 26. Loop attachment 18 can secure loop 16 to back side 19 and strap attachment 22 can secure strap 20 to back side 19 by glue, heat sealing or any other method known to those skilled in the art.

Figure 1:
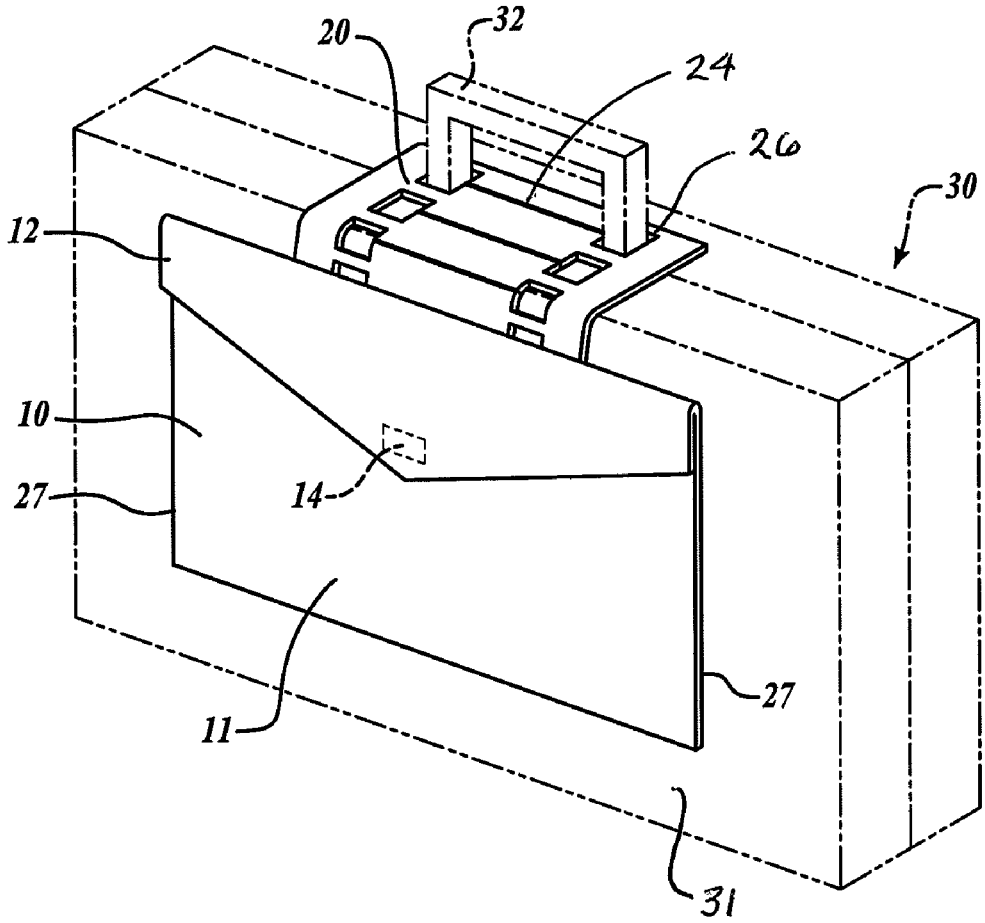
FIG. 1 is a perspective view of one embodiment of the invention attached to a case.

FIG. 1 shows carrier 11 attached to case 30 against side wall 31 by inserting handle 32 through handle cut outs 26 and slits 24 in strap 20. Carrier 11 has front side 10, back side 19 (FIG. 2), closure flap 12, fastener 14, and sides of the carrier 27. Carrier 11 is attached to case 30 using strap 20. Handle 32 is inserted through one of a plurality of slits 24 and handle cut outs 26 on strap 20. The choice of which of the slits and cut outs selected, in which handle 32 is to be inserted through depends on the size, shape and especially the thickness of the case to which carrier 11 is to be attached. Strap 20 is preferably inserted through loop 16 before the carrier is attached to case 30. Loop 16 provides added stability to the back side 19 of carrier 11 especially when attached to larger or oddly shaped cases. It should be understood that in the process of attaching and manufacturing loop 16 to carrier 11, loop 16 should be wide enough to allow strap 20 under it, but still keep the body of carrier 11 close to the case it is attached to in order to provide enhanced stability when used with large and/or oddly shaped cases. In the preferred embodiment, strap attachment 22 is mounted on the lower one third of the back side 19 in order to accommodate cases of various sizes and shapes. This permits the strap to extend directly to the case handle. However, to add stability, the strap usually is inserted through loop 16 to provide added stability as the strap 20 would then extend from the top portion of back side 19.

In one embodiment, flap 12 is constructed as an extension of back side 19 to project over front side 10. This provides a means to secure the contents of carrier 11 inside the carrier. Moreover, flap 12 provides protection from the elements such as rain. On the inside cover of flap 12 and the front side 10, of carrier 11 is at least one fastener 14. Fastener can be of snap, hook and loop, clasp or any other fastener known to those skilled in the art. The sides of the carrier 27 can be expandible to accommodate articles of various thickness. In the preferred embodiment, carrier 11 is sized to carry sheets of music.

Figure 3:
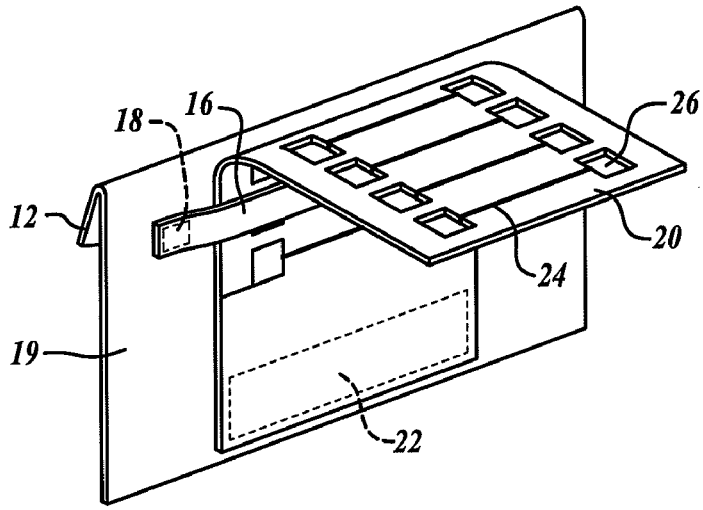
FIG. 3 is a perspective view of the back of the invention showing the fastening strap engaged behind the upper guide strap.

FIG. 3 shows the back side of the carrier 19 with strap 20 secured under loop 16. This configuration enhances stability especially when carrier 11 is attached to a large and/or oddly shaped case.

Figure 4:
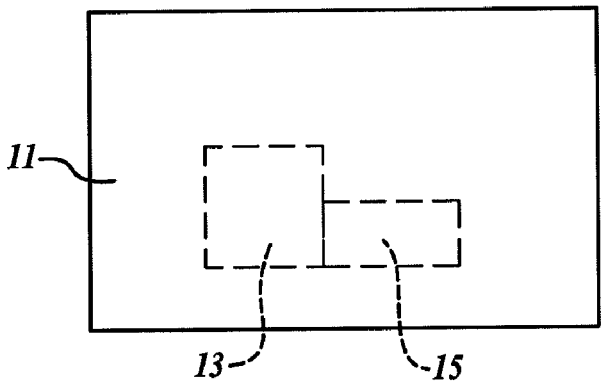
FIG. 4 is a front elevational view of pockets located on the inside of the invention.

FIG. 4 shows the inside of the carrier 11. Specifically, FIG.4 shows the interior with pockets 13 and 15. There can be a plurality of pockets of different sizes and shapes inside carrier 11. The pockets accommodate pencils, business cards, calculators, cell phones and other object which need to be carried. The pockets can also be attached to the inside face of the front side 10. Alternately, the pockets could be attached to the outside of front side 10, under or on flap 12.

Figure 5:
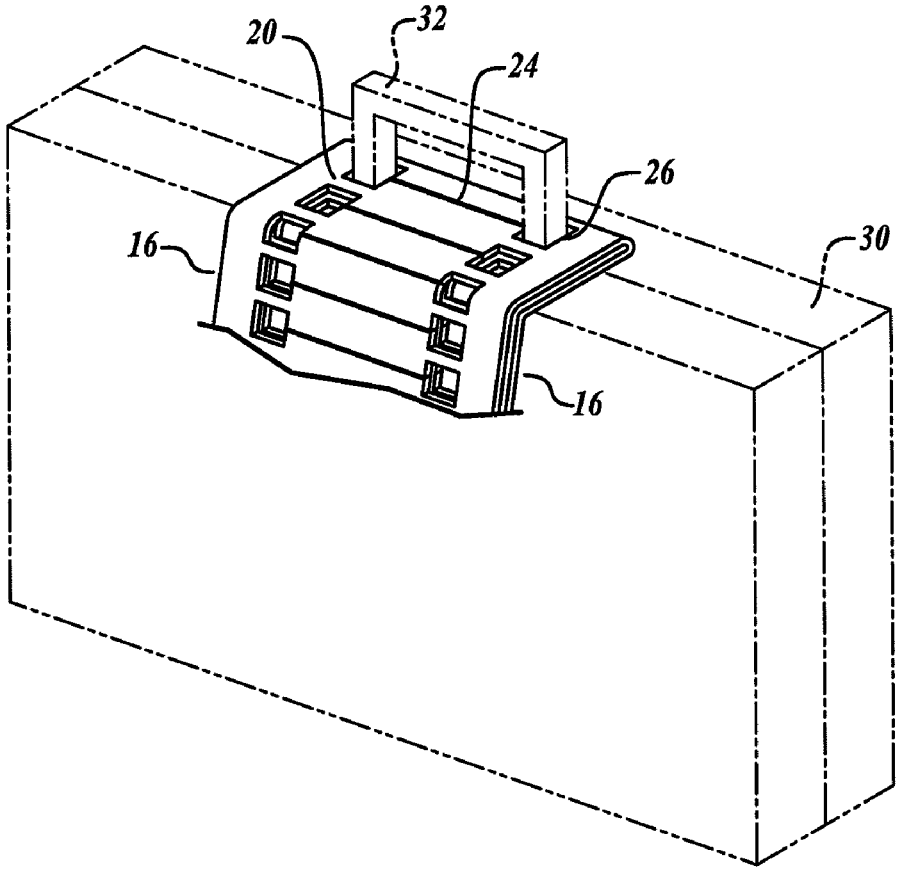
FIG. 5 is a partial perspective view of the fastening strap attached to a case with excess strap folded back against the carrier.

FIG. 5 shows a partial perspective view of strap 19 attached to the handle 32 with the remainder of carrier 11 cut away. Strap 16 conforms to the contours of case 30. FIG. 5 illustrates that the carrier 11 is adjacent only to one side of case 30 and does not interfere with the use of the handle 32. This allows the user to freely open the case 30 without interference from carrier 11. Moreover, FIG. 5 illustrates the interaction of handle 32 and strap 20. Handle 32 is inserted through strap 20. Specifically, slit 24 permits entry of the top of the handle 32 through strap 20 and handle cut outs 26 allow carrier 11 to be securely attached to case 30. Strap 20, slit 24 and handle cut out 26 can be reinforced as needed with a suitably strong material along the periphery thereof. Excess may be trimmed or the excess may be folded under for future use with larger cases.

In one embodiment, front wall 10 and back wall 19 are made of generally orthogonal pieces of material that are joined at their periphery. The joint can be by staples, glue, heat sealing or any other method known to those skilled in the art. In the preferred embodiment, carrier 11 is constructed partially or completely of transparent polyurethane material because of water resistance, transparency, ease of manufacture and relative low cost. The material is chosen to provide adequate protection to articles stored inside. However, carrier 11 could be made from nylon, leather or any other suitable material known to those skill in the art.

Figure 6:
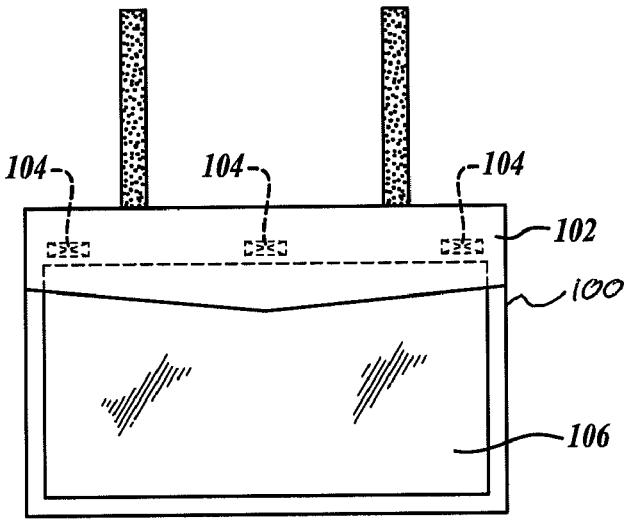
FIG. 6 is a front elevational view of another embodiment of the invention.
Figure 7:
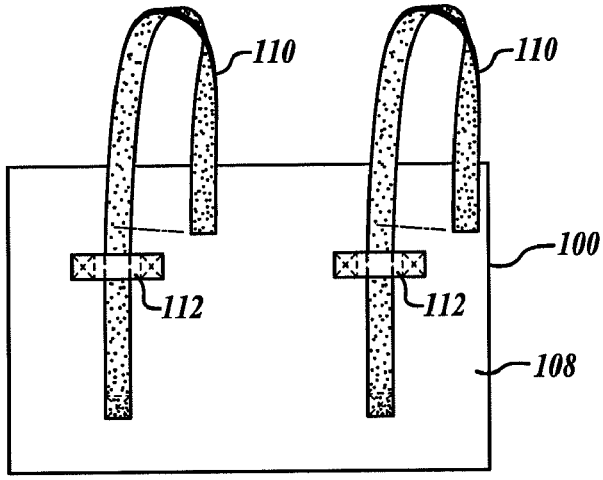
FIG. 7 is a rear elevational of the back side of the embodiment shown in FIG. 6.
Figure 8:
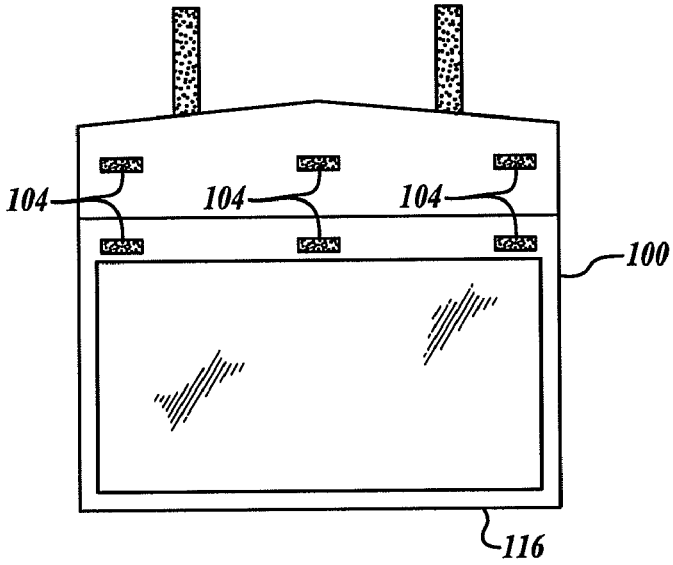
FIG. 8 is a front elevational view of the embodiment of the invention shown in FIG. 6 with the closure flap open.

As illustrated in FIGS. 6-8, a combination of transparent and non-transparent materials could be used such as a transparent polypropylene material that is formed into a window with a woven nylon material forming the remainder of the body. A nylon peripheral border can also be included around the edges of the invention for structural and aesthetic purposes. This would serve the aesthetic function as well as to protect the edges of the invention from fraying or other damage. A logo can also be included as desired through molding, glue, stitching or other methods.

In the embodiment shown in FIGS. 6-8, carrier 100 comprises a translucent front panel 106, an closure flap 102, rear panel 108, perferrably formed from a nylon or equivalent fabric, fastening straps 110 and hook and loop closure fasteners 104. The periphery 116 is formed from a nylon or equivalent fabric welt 116. The bag can be of any shape and size appropriate.

A method is also disclosed in carrying sheet music in a translucent folder. The folder, shown in FIGS. 1-5, would have generally orthogonal walls and in one embodiment, would have expandible sides to accommodate articles of varying thickness. The sides of the folder can be joined by glue, staples, heat sealing or any other method known to those skilled in the art. The back side 19 would extend over the folder's front side 11 to form a closure 12 in the form of a flap which keeps the sheet music and related articles securely inside the folder with a fastener. The folder is attached to a strap 20 having a plurality of slots. The strap 20 is attached to the back side of the folder.

The user places the back side 19 of the folder 10 adjacent case 30. The user then decides which of the plurality of slots 24 in strap 20 is appropriate to accommodate the shape and size of the case. Once the appropriate slot is selected, the user then inserts the case handle through the slot so the strap lies over the handle. The user then inserts sheet music or other documents and things inside the carrier and securely fastens the flap to ensure the articles are protected and secure.

An alternate embodiment would enable a user to provide added stability to the carrier while attached to the case. This may be needed if the case is oddly shaped and/or sized. Before the user attaches the carrier to the case, the user inserts the strap 20 though loop 16 on the back of the folder. The user then places the carrier adjacent the case to determine which slot 24 in strap 20 is appropriate to place over the handle. Once the user places the handle through the appropriate slot, the loop then serves to provide added stability to the carrier while attached to the case.

FIGS. 6-8 illustrate another embodiment of the invention. Illustrated here are folder 100, flap 102, front panel 106, back panel 108, a hook and loop closure 104, logo 114, hook and loop straps 110, loops 112 and nylon border 116. Folder 100 is attached to a case handle by using straps 110. Straps 110 are attached at or near the bottom of back panel 108. At least one strap is used to enhance stability and security to the case handle. Depending on the size and shape of the case, loops 112 can be used with straps 110. Loops 112 are attached at or near the top of back panel 108. At least one loop 112 can be provided in different positions on the back panel 108 to accommodate cases of different shape and size. Each of the straps 110 are inserted through a loop 112. This serves to abut the back panel 108 to a side of the case before the straps are attached to the case handle. Straps 100 are constructed from hook and loop material so that the straps may be engaged to securely fasten thereof. Once the straps engage the handle, the excess hook and loop strap is trimmed and the strap is pressed together so that the hook and loop fasteners become engaged.

It should be understood that in the process of attaching and manufacturing the loop to the folder, the loop should be wide enough to allow the strap under it, but still keep the body of the folder close to the case it is attached to in order to provide enhanced stability to large and/or oddly shaped cases.

Also included is a method of using the above embodiment. This method is directed toward carrying sheet music in a folder having a translucent front panel. The folder has generally orthogonal walls and in one embodiment, has expansible sides to accommodate articles of varying thickness. The sides of the folder can be joined by glue, staples, heat sealing or another other method known to those skilled in the art. The folder's backside extends upwardly into a flap which extends over the front of the folder. This flap keeps the sheet music and related articles securely inside the folder with at least one fastener. The folder has at least one hook and loop strap extending upwardly from the back surface of the folder. A plurality of strap engaging loops is fastened to the back surface near the top thereof.

The user places the backside of the folder adjacent to the case. The user then decides which of the loops to insert the strap though. This would be determined by the size and shape of the case. Once the loops, if any, are selected, the user inserts the straps through the loops. The straps are then wrapped around the handle and back inter contact with a lower portion of the strap. The excess hook and loop strap is then trimmed and the folder is securely attached to the case. The user can then insert sheet music documents, manuscripts or music related articles inside the carrier and securely fasten the flap to ensure the articles are secure.

While there have been described what are considered to be preferred embodiments of the present invention and the methods of use, it will be readily appreciated by those skilled in the art that modifications can be made without departing from the scope of the teachings herein.

INDUSTRIAL APPLICABILITY

The disclosure herein has applicability to the field of supplementing the carrying capacity of cases equipped with at least one handle.

In compliance with the statute, the invention has been described in language more or less specific as to structural features. It is to be understood, However, that the invention is not limited to the specific features shown or described, since the means and construction shown or described comprise preferred forms of putting the invention into effect. The invention is, therefore, claimed in any of its forms or modifications within the legitimate and valid scope of the appended claims, appropriately interpreted in accordance with the doctrine of equivalents.

What is claimed is:

1. A combination comprising:

a. a case of substantial thickness having a side wall, top wall a bottom wall and a carry handle attached to said top wall;

b. a folder having a front side, and a back side said folder providing at least one carrying compartment for articles placed therein, the folder having a flap extending from the back side of the folder, folded over the front side of the folder whereby the flap covers an opening on the front side of the folder;

c. a strap extending from the back side of the folder, the strap having a plurality of elongated slots extending transversely therethrough along its length to accommodate various thicknesses of said case, each of the slots of configuration to receive and accept the carry handles of the case, when extended therethrough in abutting the back side of the folder against one of the side walls of the case and;

d. a loop on the back side of the folder of configuration to accept and secure the strap, whereby said folder is positioned against said side wall supported in place by said strap engaged upon said handle and the loop aides in stabilizing the folder to the side wall of the case.

2. The combination of claim 1, wherein the folder flap has a hook and loop closure on the inner side of the flap for keeping items inside the carrier when the carrier is closed.

3. The combination of claim 1, wherein the folder flap has a snap closure on the inner side of the flap for keeping items inside the carrier when the carrier is closed.

4. The combination of claim 1, wherein the folder flap has a clasp closure on the inner side of the flap for keeping items inside the carrier when the carrier is closed.

5. The combination of claim 1, wherein the folder has a translucent front panel permitting a view of the contents thereof.

6. The combination of claim 1, wherein the folder is made of plastic.

7. The combination of claim 1, wherein the folder is made of nylon.

8. A carrier providing at least one carrying compartment for music sheets and music related articles placed therein and to be removably secured upon a side of a case having a carry handle, the carrier comprising:

a. a folder comprised of an orthogonally shaped front side and an orthogonally shaped back side that are joined around the periphery thereof, with a slot in the front wall to receive one or more pieces of music sheets and music related articles and having a flap with a closure;

b. a strap extending from the side of the carrier contacting the case having a plurality of elongated slots extending transversely therethrough along its length to accommodate various thicknesses of cases, wherein each slot wide enough to overlie and accept the carry handle of the case when extended therethrough in abutting the side of the carrier against the case;

c. a loop on the back side of the folder of configuration to accept the strap, whereby the plurality of slots enables a user to chose which slot to overlie the handle depending on the width of the case to secure said carrier against the side of said case and the loop aides in stabilizing the folder to the back side of the case.

9. The combination of claim 8, wherein the folder flap has a hook and loop closure on the inner side of the flap for keeping items inside the carrier when the carrier is closed.

10. The combination of claim 8, wherein the folder flap has a snap closure on the inner side of the flap for keeping items inside the carrier when the carrier is closed.

11. The combination of claim 8, wherein the folder flap has a clasp closure on the inner side of the flap for keeping items inside the carrier when the carrier is closed.

12. The combination of claim 8, wherein the flap is an extension of the back side of the folder, folded over the front side of the folder.

* * * * *